US010797382B2

(12) United States Patent
Wu et al.

(10) Patent No.: US 10,797,382 B2
(45) Date of Patent: Oct. 6, 2020

(54) WEARABLE ELECTRONIC DEVICE

(71) Applicant: PEGATRON CORPORATION, Taipei (TW)

(72) Inventors: Chien-Yi Wu, Taipei (TW); Chao-Hsu Wu, Taipei (TW); Shih-Keng Huang, Taipei (TW); Ya-Jyun Li, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 211 days.

(21) Appl. No.: 15/448,604

(22) Filed: Mar. 3, 2017

(65) Prior Publication Data

US 2018/0006364 A1 Jan. 4, 2018

(30) Foreign Application Priority Data

Jun. 30, 2016 (TW) ..... 105120840 A

(51) Int. Cl.
*H01Q 1/22* (2006.01)
*H01Q 1/27* (2006.01)
(Continued)

(52) U.S. Cl.
CPC ..... *H01Q 1/273* (2013.01); *H01Q 1/2283* (2013.01); *H01Q 1/48* (2013.01); *H01Q 5/30* (2015.01);
(Continued)

(58) Field of Classification Search
CPC ..... A44C 5/00; G04R 60/02; G04R 60/04; G04R 60/06; H04B 1/385; H01Q 1/273;
(Continued)

(56) References Cited

U.S. PATENT DOCUMENTS 5,006,821 A * 4/1991 Tam ..... H01P 5/185 333/116
5,699,319 A * 12/1997 Skrivervik ..... G04G 21/04 343/718
(Continued)

FOREIGN PATENT DOCUMENTS

CN 104635484 A 5/2015
TW 392098 B 6/2000
TW 201438337 A 10/2014

*Primary Examiner* — Dimary S Lopez Cruz
*Assistant Examiner* — Bamidele A Jegede
(74) *Attorney, Agent, or Firm* — McClure, Qualey & Rodack, LLP

(57) ABSTRACT

A wearable electronic device includes a middle frame, two connecting sidewalls, a first metal sidewall, a first dielectric component and a first antenna layout trace circuit. The two connecting sidewalls are disposed at two opposite sides of the middle frame for connecting a wearable component. The first metal sidewall is disposed at the middle frame and located between the two connecting sidewalls. The first metal sidewall is connected to ground and includes a first slot. The first dielectric component is installed in the first slot, so that the first metal sidewall surrounds the first dielectric component to form a first closed ground structure. The first antenna layout trace circuit is installed on the first dielectric component. The first antenna layout trace circuit and the first closed ground structure associate a first resonate frequency.

8 Claims, 4 Drawing Sheets

(51) Int. Cl.

| | |
|---|---|
| ***H01Q 9/42*** | (2006.01) |
| ***H01Q 21/28*** | (2006.01) |
| ***H01Q 5/30*** | (2015.01) |
| ***H01Q 1/48*** | (2006.01) |
| ***H01Q 21/00*** | (2006.01) |

(52) U.S. Cl.
CPC ..... *H01Q 9/42* (2013.01); *H01Q 21/0068* (2013.01); *H01Q 21/28* (2013.01)

(58) Field of Classification Search
CPC ..... H01Q 9/42; H01Q 21/28; H01Q 5/30; H01Q 1/2283; H01Q 1/48; H01Q 21/0068
See application file for complete search history.

(56) References Cited

U.S. PATENT DOCUMENTS 6,014,112 A * 1/2000 Koscica ..... H01Q 1/246 343/700 MS
6,222,494 B1 * 4/2001 Erkocevic ..... H01P 9/02 343/727
6,529,170 B1 * 3/2003 Nishizawa ..... H01Q 1/38 343/700 MS
7,215,600 B1 * 5/2007 DeRosa ..... G04G 21/04 343/718
9,257,740 B2 2/2016 Lyons et al.
2002/0190912 A1 * 12/2002 Lebaric ..... H01Q 9/28 343/795
2004/0145522 A1 * 7/2004 Wang ..... H01Q 1/38 343/700 MS
2005/0020302 A1 * 1/2005 Ikeda ..... H04B 1/385 455/556.1
2005/0068243 A1 * 3/2005 Chen ..... H01Q 1/38 343/790
2006/0003721 A1 * 1/2006 Bisig ..... G04R 60/04 455/269
2006/0202898 A1 * 9/2006 Li ..... H01Q 1/1271 343/713
2007/0052589 A1 * 3/2007 Liu ..... H01Q 1/38 343/700 MS
2007/0097008 A1 * 5/2007 Chen ..... H01Q 1/38 343/795
2007/0210975 A1 * 9/2007 Someya ..... G04G 21/04 343/788
2007/0252773 A1 * 11/2007 Soler Castany ..... H01Q 1/242 343/846
2008/0055179 A1 * 3/2008 Tao ..... H01Q 9/38 343/795
2008/0106478 A1 * 5/2008 Hill ..... H01Q 1/243 343/702
2009/0305657 A1 * 12/2009 Someya ..... H01Q 1/273 455/269
2010/0265151 A1 * 10/2010 Chou ..... H01Q 1/2291 343/843
2011/0012796 A1 * 1/2011 Kim ..... H01Q 1/273 343/702
2012/0056792 A1 * 3/2012 Han ..... G04R 60/04 343/718
2014/0086026 A1 * 3/2014 Mitani ..... G04R 60/12 368/278
2014/0225787 A1 * 8/2014 Ramachandran ..... H01Q 7/00 343/702
2014/0285385 A1 * 9/2014 Aoki ..... H01Q 5/378 343/702
2015/0130666 A1 * 5/2015 Pan ..... H02J 7/0045 343/702
2016/0006110 A1 * 1/2016 Jain ..... H01Q 5/328 343/702
2016/0056526 A1 2/2016 Li et al.
2016/0064804 A1 * 3/2016 Kim ..... H01Q 15/008 343/702

* cited by examiner

WEARABLE ELECTRONIC DEVICE

CROSS-REFERENCE TO RELATED APPLICATION

This application claims the priority benefit of Taiwan application serial no. 105120840, filed on Jun. 30, 2016. The entirety of the above-mentioned patent application is hereby incorporated by reference herein and made a part of this specification.

BACKGROUND

Technology Field

The disclosure relates to a wearable electronic device and, more particularly, to a wearable electronic device having an antenna with a closed ground structure.

Description of the Related Art

Smart devices such as smart phones, smart watches, fitness trackers, tablets and the likes, are usually equipped with Wi-Fi function. For being portable, the design of those products tends towards smaller size. Nevertheless, it is not quite easy to install an antenna on those smaller and smaller devices. In the prior art, an antenna is always installed on a strap of a watch or near a joint part of the main body and the strap. Therefore, the performance of the antenna is impacted by the strap material. For example, metal, plastic or leather straps might somewhat have impacts or interferences on the antenna performance.

Conventionally, the installation of the antenna must be made through a breaking joint on the electronic device with a metal shell. It allows that the signal side is electrically insulated from other parts of the main body, and reduces the impact caused by touch between the human body and the metal shell.

SUMMARY

The present invention provides a wearable device. The wearable device includes a middle frame, two connecting sidewalls, a first metal sidewall, a first dielectric component and a first antenna layout trace circuit. The two connecting sidewalls are disposed at two opposite sides of the middle frame. The first metal sidewall is disposed at the middle frame and located between the two connecting sidewalls. The first metal sidewall is connected to ground and has a first slot. The first dielectric component is installed in the first slot to allow that the first metal sidewall surrounds the first dielectric component to form a first closed ground structure. The first antenna layout trace circuit is installed in the first dielectric component. The first antenna layout trace circuit and the first closed ground structure are associated with a first resonate frequency.

According to the disclosure of the present invention, the wearable electronic device can be designed with a metal shell under specific absorption rate (SAR) specification. In addition, the wearable electronic device has more efficient use of space as well as more antenna circuits for different frequency bands because of the installation of the antenna layout trace circuits on the sidewall. Moreover, the manufacture process in which the slot is opened on the sidewall for the installation of the dielectric component is simpler than the breaking joint design on the metal frame. The product also looks better on the appearance. Without the breaking joint, the wearable electronic device has advantages such as high throughput, low cost and simplicity for a mass production.

These and other features, aspects, and advantages of the present invention will become better understood with regard to the following description, appended claims, and accompanying drawings.

DETAILED DESCRIPTION

The following detailed description is elaborated by embodiments in cooperation with drawings, but the specific embodiments described below are for the purpose of explaining the present invention and are not intended to be a limitation of the present invention. The structural description is not intended to limit the order in which they are performed. Devices that are reassembled from any elements and have equal efficacy are all within the scope of the present disclosure. In addition, the drawings are only illustrative and not drawn in accordance with their true dimensions.

Figure 1A:
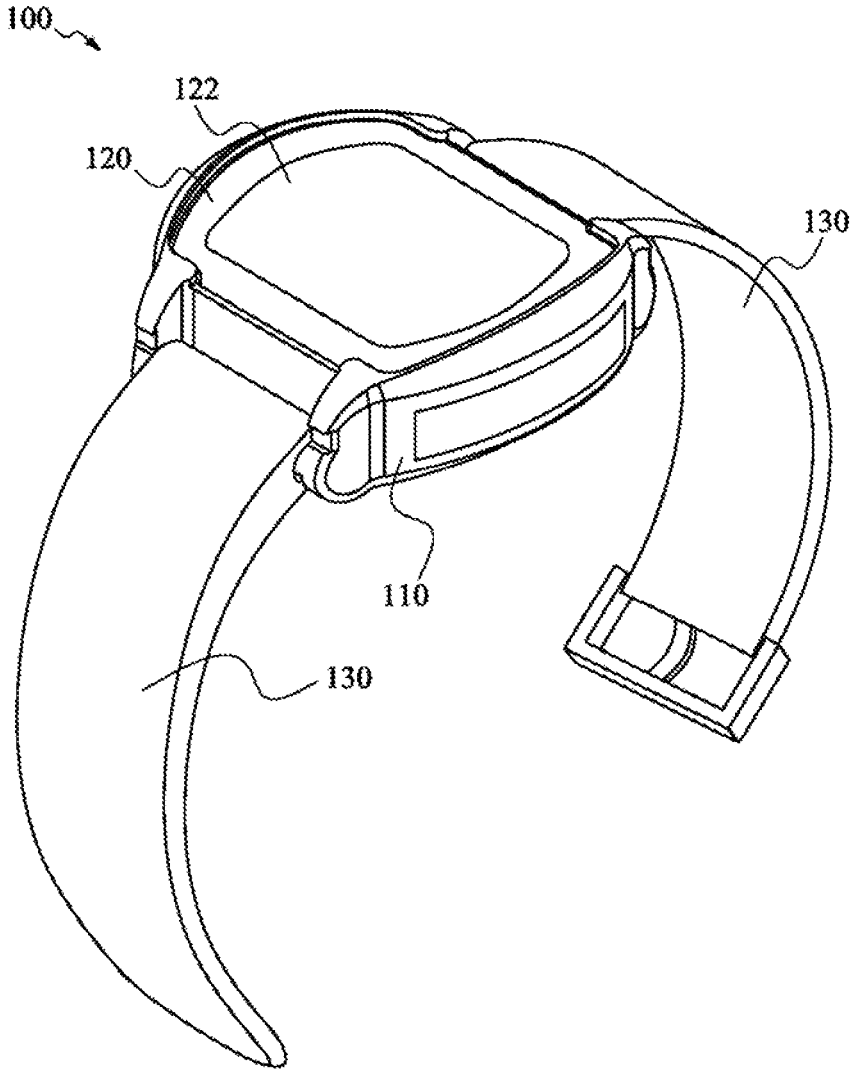
FIG. 1A is a schematic diagram of a wearable electronic device according to an embodiment of the present invention.

FIG. 1A is a schematic diagram of a wearable electronic device 100 according to an embodiment of the present invention. The wearable device 100 is, for example a watch. Practically, the wearable electronic device 100 could be a smart wristband or positioning tracker and the likes. Besides, the wearable electronic device of the present invention may be formed in an arc shape on both sides. However, the shape of the wearable electronic device may be rectangular, streamlined, or even irregular.

The main body of the wearable electronic device 100 includes a middle frame 110, a watch ring 120, a display panel 122 and a watch strap 130. At the middle frame 110 are disposed with a system and antennas of the wearable electronic device 100. The middle frame 110 is used for connecting the watch ring 120 with the watch strap 130. The watch ring 120 is used for an installation of the display panel 122. Through a design of the wearable electronic device of the present invention, the material of the watch ring 120 and the watch strap 130 does not have any impact on the antenna performance. Thus, the watch ring 120 and the watch strap 130 could be made of any material such as metal, plastic or carbon fiber.

Figure 1B:
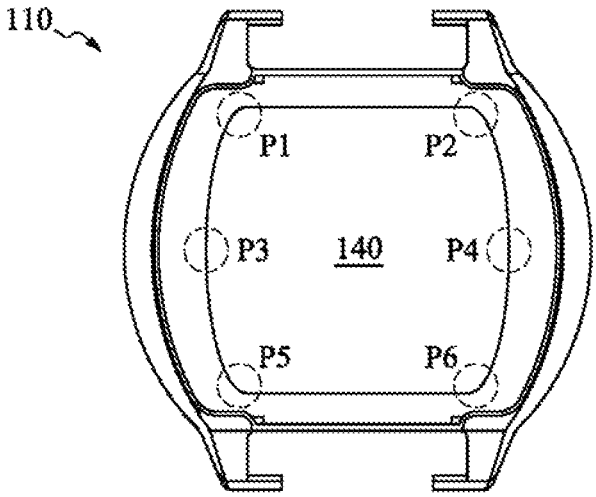
FIG. 1B is a top view diagram of a wearable electronic device according to an embodiment of the present invention.
Figure 1C:
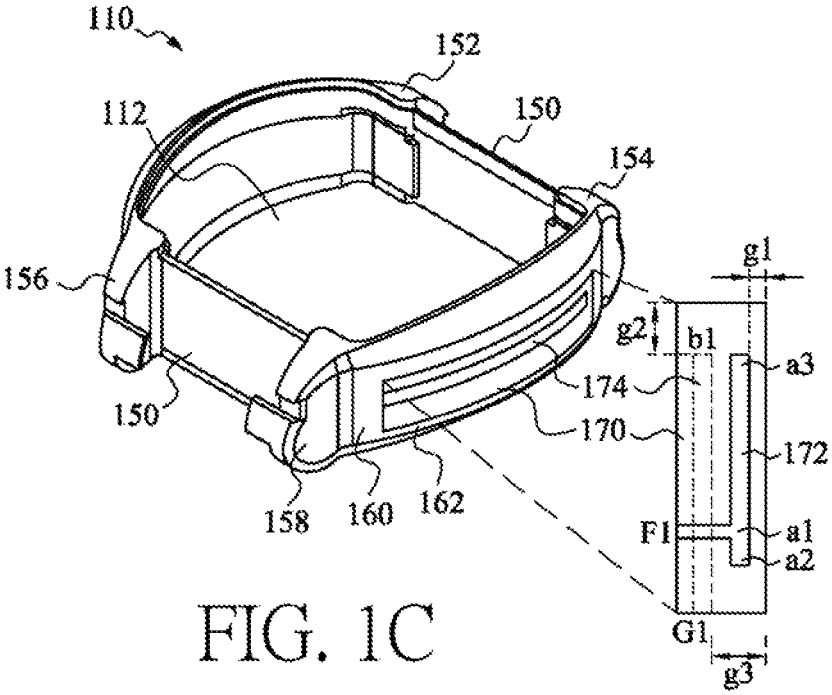
FIG. 1C is a schematic diagram of a wearable electronic device according to an embodiment of the present invention.

Please cross-refer to FIGS. 1B and 1C. FIGS. 1B and 1C illustrate top view diagrams of the wearable electronic device 100 according to embodiments of the present invention. In FIG. 1C, the middle frame 110 of the wearable electronic device 100 includes a bottom 112. The wearable electronic device 100 further includes a metal sidewall part, which is formed at the middle frame 110 and is perpendicular to the bottom 112. A side of the bottom 112 includes a system ground 140, as shown in FIG. 1B. Six discrete ground points P1, P2, P3, P4, P5 and P6 are located between the system ground 140 and the metal sidewall part, which assures that the device completely connects to ground. It is noted that the location and the number of the ground points of the present invention is not limited herein. The skilled in the art can modify the location and the number of the ground points according to the requirements of a practical design.

The metal sidewall part includes two connecting sidewall 150 and a first metal sidewall 160. The two connecting sidewalls 150 are located at two opposite sides of the middle frame 110 for connecting wearable components, such as the watch strap 130, through protruding pans 152, 154, 156 and 158. The protruding parts 152, 154, 156 and 158 could be any linking structure to meet the practical requirements. The first metal sidewall 160 is disposed at the middle frame 110 and located between two connecting sidewalls 150, as shown in the right side of FIG. 1C. The metal sidewall 160 includes a first slot 162, and the size of the first slot 162 may be 45 mm×7 mm. A first dielectric component 170 is installed in the first slot 162. The first dielectric component 170 could be a plastic supporting component. Since the first metal sidewall 160 is connected to ground and the first metal sidewall 160 surrounds the first dielectric component 170, the first dielectric component 170, in fact, is surrounded by the ground to form a first closed ground structure.

An antenna layout trace circuit is installed on the first dielectric component 170. The antenna layout trace circuit could be manufactured from, for example a flexible printed circuit (FPC) antenna pattern or a laser direct structuring (LDS) printed antenna pattern. The antenna layout trace circuit includes an antenna pattern 172 installed on the inner side of the dielectric component 170 and an antenna pattern 174 installed on the outer side of the dielectric component 170. The antenna pattern 174 is illustrated on the outer side of the middle frame 110 and magnified in the area confined by the dashed lines on the right side of the figure. The dotted line represents that the antenna pattern 174 is located on the back side of the antenna pattern 172. The antenna patterns 172 and 174 both are made of conductive material. The antenna pattern 172 has a signal feed end F1. The antenna layout trace circuit is coupled to a positive electrode of a coaxial transmission line of an RF transceiver (not shown) of the wearable electronic device 100 through the signal feed end F1. One end of the antenna pattern 174 is a ground end G1. The ground end G1 is coupled to the first metal sidewall 160 for connecting to the ground and coupled to a negative electrode of the coaxial transmission line of the RF transceiver (not shown).

As shown in FIG. 1C, there are gaps g1 and g2 between the antenna pattern 172 and the first metal sidewall 160; and there is a gap g3 between the first antenna pattern 174 and the first metal sidewall 160. The gap g1 is, for example 1 mm; the gap g2 is, for example 5 mm; the gap g3 is, for example 2.5 mm. Through a coupling effect, the antenna patterns 172 and 174, and the metal sidewall 160 surrounding thereof associate a first resonate frequency and form a closed-loop antenna structure, which allows the wearable electronic device 100 to receive and transmit RF signals.

The path length from a point a1 to a point a2, the path length from the point a1 to a point a3 on the antenna pattern 172, or/and the path length from a point b1 to the ground end G1 on the antenna pattern 174 correspond to a central frequency of the first resonate frequency. Thus, by changing the path length from the point a1 to the point a2, the path length from the point a1 to the point a3 or/and the path length from the point b1 to the ground end (G1, the first resonate frequency for example a frequency band of a GPS antenna (about 1575 MHz) can be adjusted. Besides, the gaps g1 and g2 between the antenna pattern 172 and the first metal sidewall 160 and the gap g3 between the antenna pattern 174 and the first metal sidewall 160 correspond to an impedance matching bandwidth of the first resonate frequency. By changing the gaps g1, g2 and g3, the effect of the impedance matching bandwidth could be adjusted.

Figure 2:
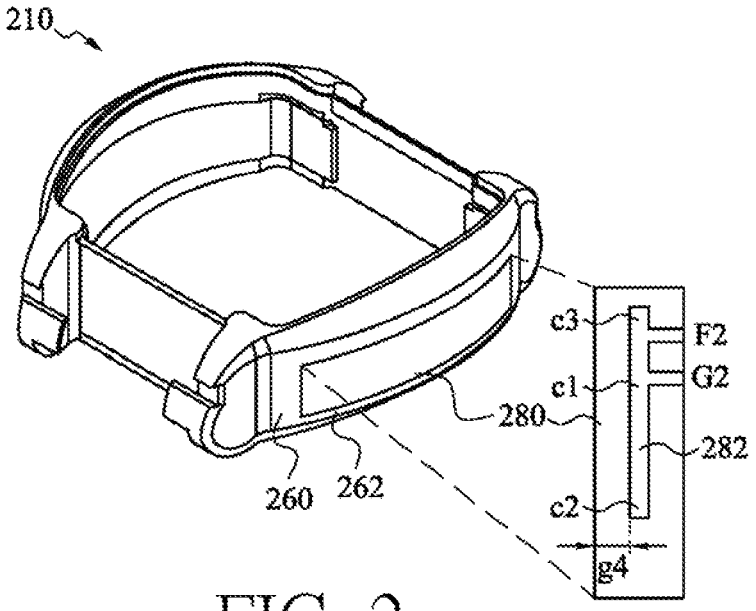
FIG. 2 is a schematic diagram of a wearable electronic device according to at embodiment of the present invention.

In another embodiment of the present invention, the right side of the middle frame of the wearable electronic device can adopt different antenna patterns to operate in different antenna frequency bands. As shown in FIG. 2, FIG. 2 illustrates a wearable electronic device according to an embodiment of the present invention. The wearable electronic device of this embodiment has the same middle frame 110 and the metal sidewall part as described above. Likewise, one side of the metal sidewall part includes a metal sidewall 260 and the metal sidewall 260 has a first slot of 45 mm×7 mm. A first dielectric component 280 is installed in the first slot 262. Since the first metal sidewall 260 is connected to the system ground, it means that the first dielectric component 280 is surrounded by the ground to form a first closed ground structure.

On the first dielectric component 280 is installed an antenna layout trace circuit. The antenna layout trace circuit includes an antenna pattern 282 installed on the inner side of the first dielectric component 280. The antenna pattern 282 is made of conductive material and has a signal feed end F2 and a around end G2. The antenna layout trace circuit is coupled to a positive electrode of a coaxial transmission line of an RF transceiver (not shown) of the wearable electronic device via the signal feed end F2 and coupled to a negative electrode of the coaxial transmission line of the RF transceiver (not shown) via the ground end G2. The ground end G2 is also coupled to the first metal sidewall 260 to electrically connect to the system ground.

There is a gap g4 between the antenna pattern 282 and the first metal sidewall 260, as shown in FIG. 2. In this embodiment, the gap g4 is, for example 1.5 mm. Through a coupling effect, the antenna pattern 282 and the first metal sidewall 260 surrounding thereof associate a second resonate frequency, which allows the wearable electronic device to receive and transmit RF signals on a different frequency than the first resonate frequency.

The path length from a point c1 to a point c2 and the path length from the point c1 to a point c3 on the antenna pattern 282 correspond to a central frequency of the second resonate frequency. Thus, by changing the path length of the point c1 to the point c2 and/or the path length from the point c1 to the point c3 on the antenna pattern 282, the second resonate frequency can be adjusted to a Bluetooth/Wi-Fi frequency band (about 2.4 GHz). Besides, the gap g4 between the antenna pattern 282 and the first metal sidewall 260 corresponds to an impedance matching bandwidth of the second resonate frequency. Therefore, the adjustment of the impedance matching bandwidth for Bluetooth/Wi-Fi antenna can be achieved by changing the gap g4.

Figure 3:
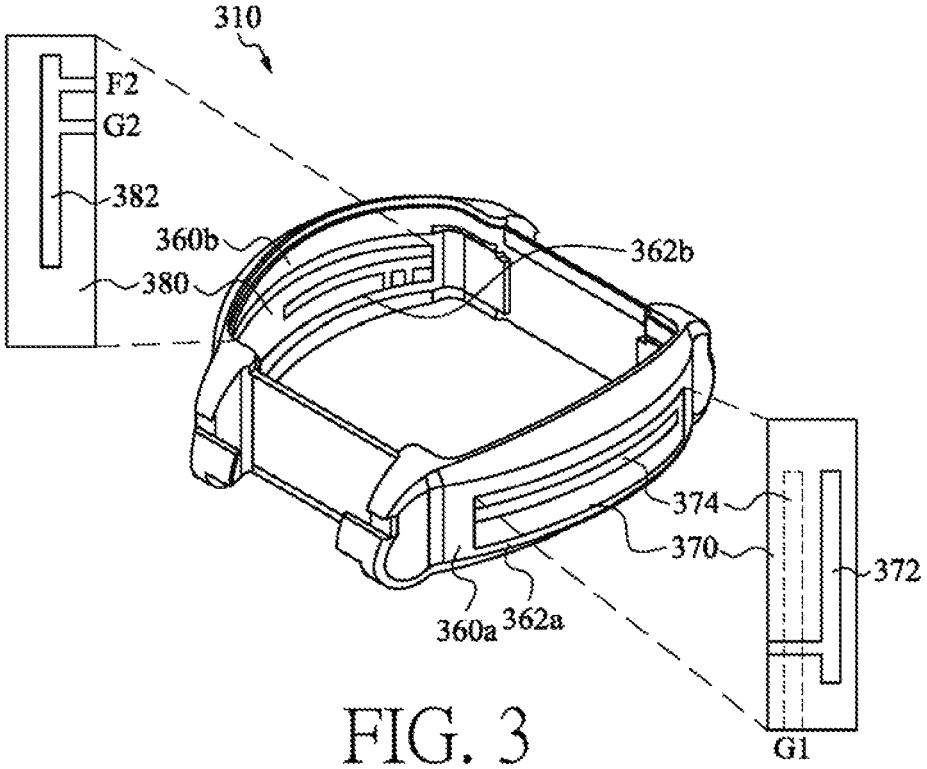
FIG. 3 is a schematic diagram of a wearable electronic device according to an embodiment of the present invention.

In another embodiment of the present invention, the embodiments in FIG. 1C and FIG. 2 can be combined to implement a small-sized wearable electronic device capable of operating on different antenna frequencies. FIG. 3 is a schematic diagram of a wearable electronic device according to an embodiment of the present invention. A middle frame 310 of this embodiment has a combined characterization of the middle frames 110 and 210. Similar to the aforementioned wearable electronic device with the middle frame 110 or the middle frame 210, one side of the metal sidewall part (e.g. right side) includes a first metal sidewall 360*a* and the first metal sidewall 360*a* has a first slot 362*a*. In the contrast to the wearable electronic devices with the middle frames 110 and 210 in the previous embodiments, the other side of the metal sidewall part (e.g. left side) of this embodiment further includes a second metal sidewall 360*b* and the second metal sidewall 360*b* has a second slot 362*b* opposite the first slot 362*a*. The metal side wall part of this embodiment is also connected to the system ground. That is, the first metal sidewall 360*a* and the second metal sidewall 360*b* are connected to the system ground as well.

A first dielectric component 370 is installed in the first slot 362*a*, which is surrounded by the grounded first metal sidewall 360*a* to form a first closed ground structure. Likewise, a second dielectric component 380 is installed in the second metal sidewall 362*b*, which is surrounded by the grounded second metal sidewall 360*b* to form a second closed ground structure. On the inner side and the outer side of the first dielectric component 370 are installed with antenna patterns 372 and 374, respectively, which are identical to the antenna patterns 172 and 174 in FIG. 1C. The antenna pattern 372 has a signal feed end F1 while the antenna pattern 374 has a ground end G1. The structures and characterizations of the antennas 372 and 374 are identical to the ones of the antennas 172 and 174 in FIG. 1C, and therefore the detailed descriptions can be found above and omitted herein. By the antenna patterns 372 and 374 resonating with the first metal sidewall 360*a*, the wearable electronic device can transmit and receive signals, for example in the frequency band of the GPS antenna.

On the inner side of the second dielectric component 380 of the opposite side is installed an antenna pattern 382 identical to the antenna pattern 282 in FIG. 2. The antenna pattern 382 has a signal feed end F2 and a ground end G2. The structure and characterization of the antenna 382 is identical to ones of the antenna 282 in FIG. 2. The detailed descriptions can be found in the embodiment regarding FIG. 2, and thus omitted herein. By the antenna pattern 382 resonating with the second metal 360*b*, the wearable device can transmit and receive signals, for example in the frequency band of the Bluetooth/Wi-Fi antenna.

According to the embodiments of the present invention, small-sized wearable devices could transmit and receive signals in the GPS and/or Bluetooth, Wi-Fi antenna frequency band(s). Besides, upon the teaching of the instant disclosure, the skilled in the art can install more antennas by modifying the layout of the antenna layout trace circuit; and/or adjusting the shape and the size of the middle frame.

Figure 4:
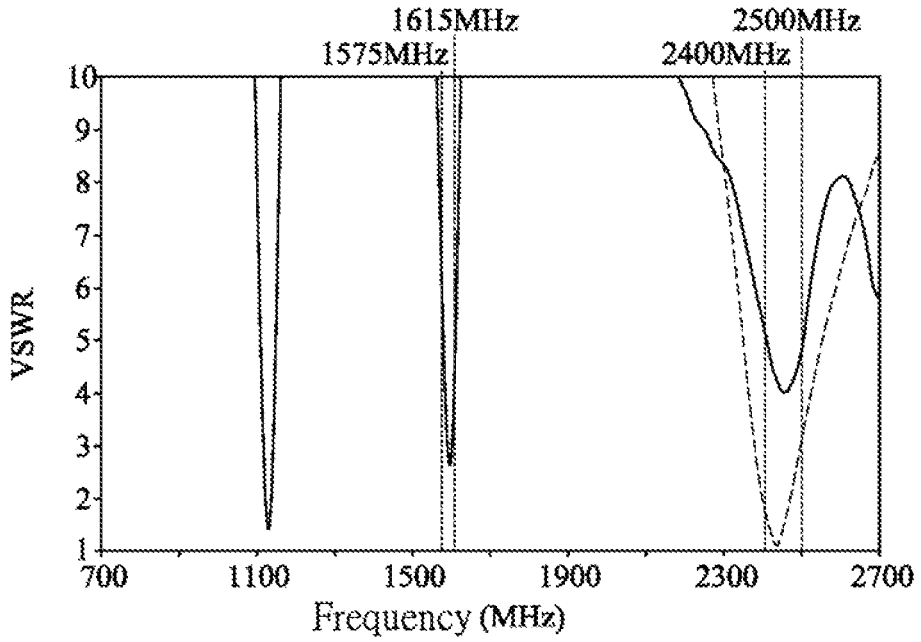
FIG. 4 illustrates a plot of VSWR versus frequency for a wearable electronic device according to an embodiment of the present invention.

FIG. 4 illustrates a plot of voltage standing wave ratio (VSWR) versus frequency for a wearable electronic device according an embodiment of the present invention. FIG. 4 is a plot of VSWR versus frequency when the aforementioned wearable electronic device operates in practice. The Y-axis represents VSWR in the plot; the X-axis represents frequency; the solid line shows VSWR of the antenna layout trace circuit (e.g. GPS antenna) on the right side of FIG. 1C or FIG. 3; the dashed line shows VSWR of the antenna layout trace circuit (e.g. Bluetooth/Wi-Fi antenna) of the left side of FIG. 2 or FIG. 3. As seen in FIG. 4, VSWR of the antenna of the wearable electronic device approximates 1 in the GPS frequency band (about 1575 MHz) and/for in the Bluetooth/Wi-Fi frequency band (about 2400 MHz), showing the excellent impedance matching.

Figure 5:
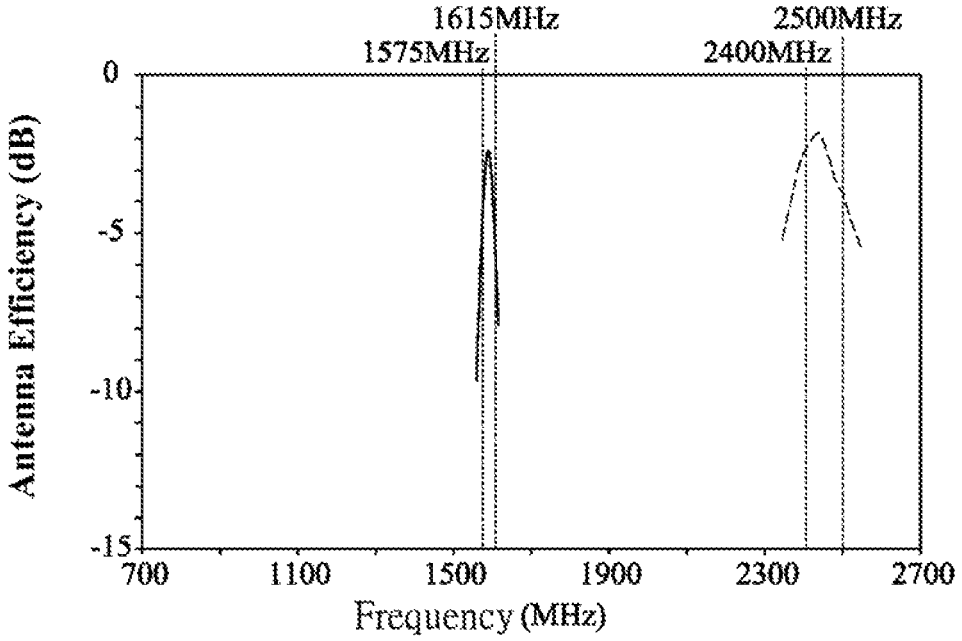
FIG. 5 illustrates a plot of antenna gain versus frequency according to an embodiment of the present invention.

FIG. 5 illustrates a plot of antenna vain versus frequency according to an embodiment of the present invention. FIG. 5 is a plot of antenna gain versus frequency when the aforementioned wearable electronic device operates in practice. The Y-axis represents antenna gain in dB; and the X-axis represents frequency. In FIG. 5, the solid line shows antenna gain of the antenna layout trace circuit (e.g. GPS antenna) on the right side of FIG. 1C or FIG. 3; and the dashed line shows frequency of the antenna layout trace circuit (e.g. Bluetooth/Wi-Fi) on the left side of FIG. 2 or FIG. 3. As seen in FIG. 5, the wearable electronic device of the instant disclosure has an excellent antenna performance in GPS frequency band (about 1575 MHz) and/or Wi-Fi frequency band (about 2400 MHz).

In an embodiment of the present invention, the antenna pattern installed on the sidewall of the middle frame (YZ plane or XZ plane) has a smaller keep-out area (clearance area) than the one on XV plane. Further, the antenna layout trace circuits for GPS and Bluetooth/Wi-Fi can be separately installed on the right and left sidewall of the middle frame. Thus, it is more flexibility in use of space of the wearable electronic device of the present invention.

According to the embodiments of the present invention, the material of the watch strap does not have any impact on the performance of the antenna installed in the middle frame because the metal sidewall part of the wearable electronic device is connected to the system ground to form the closed ground structure. That is, a watch ring and a wearable component could be made of any material. It allows the wearable electronic device to have more diverse designs.

Through a technology by which the antenna layout trace circuit is installed in the sidewall of the middle frame of the device, the electronic device has more space to install more functional components than before. The skilled in the art can install more antennas by simply modifying the size and the appearance of the wearable electronic device. By implementing the present invention, small-sized wearable electronic device not only operates in more antenna frequency bands also has a design with a metal middle frame under SAS specification.

Although the embodiments of the present invention have been described above, they are not intended to limit the present invention. A skilled in the art may, without departing from the spirit and scope of the invention, make various changes and modifications. The scope of the present invention shall be as defined in the appended claims.

What is claimed is:

1. A wearable electronic device comprising:

a middle frame;

two connecting sidewalls disposed at two opposite sides of the middle frame, for connecting a wearable component;

a first metal sidewall disposed at the middle frame and located between the two connecting sidewalls, the first metal sidewall connected to ground and having a first slot, wherein the first slot is separated from the two connecting sidewalls and the first slot is enclosed by a plurality of metal walls;

a first dielectric component installed in the first slot, wherein the first dielectric component is surrounded by the plurality of metal walls; and a first antenna layout trace circuit installed on the first dielectric component;

wherein the first antenna layout trace circuit comprises a first antenna pattern and a second antenna pattern, wherein the first antenna pattern is installed on an inner side of the first dielectric component and has a signal feed end, the second antenna pattern is installed on an outer side of the first dielectric component and has a ground end coupled to the first metal sidewall to ground the second antenna pattern, wherein the signal feed end is disposed adjacent to a first side of the first dielectric component, the ground end is disposed adjacent to a second side of the first dielectric component, and the first side is perpendicular to the second side;

wherein the first antenna pattern, the second antenna pattern, and the first metal sidewall form a resonant coupling to generate a first resonate frequency.

2. The wearable electronic device of claim 1, wherein the first resonate frequency corresponds to a length of the first antenna pattern.

3. The wearable electronic device of claim 1, wherein a gap between the first antenna pattern and the first metal sidewall corresponds to an impedance matching bandwidth of the first resonate frequency.

4. The wearable electronic device of claim 1, wherein the first resonate frequency corresponds to a length of the second antenna pattern.

5. The wearable electronic device of claim 1 further comprising:

a second metal sidewall disposed at the middle frame and located at another side between the two connecting sidewalls opposite to the first metal sidewall, and the second metal sidewall connected to ground and having a second slot;

a second dielectric component installed in the second slot, the second dielectric component surrounded by the second metal sidewall to form a second closed ground structure; and a second antenna layout trace circuit installed on the second dielectric component, the second antenna layout trace circuit and the second closed ground structure associated with a second resonate frequency.

6. The wearable electronic device of claim 5, wherein the second resonate frequency is different than the first resonate frequency.

7. The wearable electronic device of claim 5, wherein the second antenna layout trace circuit comprises a third antenna pattern installed on an inner side of the second dielectric component and having to a signal feed end.

8. The wearable electronic device of claim 7, wherein the second resonate frequency corresponds to a length of the third antenna pattern.

* * * * *